US005158559A

United States Patent [19]

Pozzobon et al.

[11] Patent Number: 5,158,559

[45] Date of Patent: Oct. 27, 1992

[54] SKI BOOT WITH A LEVER HAVING INDEPENDENT ADJUSTMENT DEVICES

[75] Inventors: Alessandro Pozzobon, Paderno di Ponzano Veneto; Roberto Gorza, Feltre; Renato Serafin, Vedelago, all of Italy

[73] Assignee: Nordica S.p.A., Montebelluna, Italy

[21] Appl. No.: 649,194

[22] Filed: Feb. 4, 1991

Related U.S. Application Data

[63] Continuation of Ser. No. 407,389, Aug. 18, 1989, abandoned.

[30] Foreign Application Priority Data

Aug. 31, 1988 [IT] Italy ..... 82581 A/88

[51] Int. Cl.[5] ..... A43B 5/04

[52] U.S. Cl. ..... 36/119; 36/50.5; 24/68 SK

[58] Field of Search ..... 36/117-121, 36/50; 24/68 SK, 69 SK, 71 SK

[56] References Cited

U.S. PATENT DOCUMENTS

| | | | |
|---|---|---|---|
| 4,615,127 | 10/1986 | Delery | 36/117 |
| 4,619,057 | 10/1986 | Sartor et al. | 36/117 X |
| 4,653,204 | 3/1987 | Morell et al. | 36/117 |
| 4,660,300 | 4/1987 | Morell et al. | 36/117 X |
| 4,680,878 | 7/1987 | Pozzobon et al. | 36/117 |
| 4,698,922 | 10/1987 | Sartor | 36/117 X |
| 4,719,670 | 1/1988 | Kurt | 36/50 X |
| 4,719,709 | 1/1988 | Vaccari | 36/117 |
| 4,719,710 | 1/1988 | Pozzobon | 36/119 |
| 4,741,115 | 5/1988 | Pozzobon | 36/117 |
| 4,754,560 | 7/1988 | Nerrinck | 36/119 |
| 4,761,859 | 8/1988 | Colabrigo | 36/117 X |
| 4,790,081 | 12/1988 | Benoit et al. | 36/117 X |
| 4,796,829 | 1/1989 | Pozzobon et al. | 36/119 X |
| 4,841,649 | 6/1989 | Baggio et al. | 36/119 X |

FOREIGN PATENT DOCUMENTS

| | | | |
|---|---|---|---|
| 0132744 | 2/1985 | European Pat. Off. | 36/119 |
| 0247487 | 12/1987 | European Pat. Off. | 36/117 |
| 0264712 | 4/1988 | European Pat. Off. | 36/117 |
| 3406591 | 8/1985 | Fed. Rep. of Germany | 36/119 |
| 3506057 | 2/1986 | Fed. Rep. of Germany | 36/117 |
| 3626837 | 2/1988 | Fed. Rep. of Germany | 36/117 |

*Primary Examiner*—Paul T. Sewell
*Assistant Examiner*—Thomas P. Hilliard
*Attorney, Agent, or Firm*—Guido Modiano; Albert Josif

[57] ABSTRACT

A ski boot composed of a shell inside which one or more pressers are provided and with which a front quarter and a rear quarter are associated. The peculiarity of the invention resides in the fact that it comprises a lever body which is pivoted to the front quarter or to the rear quarter and has independently activatable adjustment and/or securing devices for the front and rear quarters and for the pressers which are arranged inside the shell. It is therefore possible to act directly on one of the devices, for example to vary its adjustment, without affecting the other device, regardless of the activation of non-activation thereof.

7 Claims, 2 Drawing Sheets

SKI BOOT WITH A LEVER HAVING INDEPENDENT ADJUSTMENT DEVICES

This is a continuation application of application Ser. No. 07/407,389 filed on Aug. 18, 1989, now abandoned.

BACKGROUND OF THE INVENTION

The present invention relates to a ski boot, particularly of the rear-entry type, therefore composed of a shell with which a front quarter and a rear quarter are associated.

Said boot furthermore comprises inside its shell one or more pressers which are adapted, upon activation thereof, to optimally secure the foot inside said shell.

In said known kind of boot, the problem of achieving the optimum adjustment and securing of the quarters and of the foot inside the shell is currently strongly felt.

Many devices are therefore known which individually achieve the above mentioned purpose, but high costs and an overloading of the boot structure are observed indeed because this purpose is achieved by means of physically separate devices which are therefore differently located at the boot.

As a partial solution to this disadvantage, French patent application, No. 2536965 filed on Dec. 2, 1982, discloses a securing and locking device for rear-entry ski boots, constituted by a single cable which affects the foot instep region, embraces the quarters and can be locked by means of an adapted lever.

Though this device allows to simultaneously close the quarters and secure the foot inside the boot, the two functions are interdependent, and it is therefore impossible to vary the degree of securing of the quarters with respect to that of the foot instep.

Such a need is instead strongly felt in order to achieve the optimum wear of the boot.

French patent No. 2572258 filed on Oct. 30, 1984, also discloses a ski boot comprising a vertical lever which is pivoted to the rear quarter and comprises means for adjusting the closure of the quarters and the securing of the foot comprising epicycloidal gears adapted to differently wind separate cables which affect the quarters and a presser arranged inside the shell.

Even this solution, however, entails the simultaneous activation of the two functions by rotating said lever, and no adjustment is possible, either to close the quarters or to secure the foot, when the lever is activated.

Said boot therefore allows a different winding of the cables only when the vertical lever is opened, and no mutually independent activations, for example of the closure of the quarters or of the securing of the foot, are possible.

Still as a partial solution to these disadvantages, this same Assignee filed on Sep. 14, 1987 an application, No. 07/096,193 disclosing a multiple-function actuation device which comprises means adapted to selectively engage a knob and the ends of a first shaft and of a second shaft, said shafts being mutually free and coaxial.

Each of said shafts furthermore had, at its other end, a gear coupled by means of adapted kinematic systems respectively to a winding pulley for a cable and with a winder for a band or the like.

The pulley and the winder were furthermore arranged along mutually perpendicular axes and cooperated with means adapted to allow the removable locking of their rotation in the unwinding direction of the cable and of the band.

Though this device allows to independently activate the two functions, it is very complicated from a structural and constructive point of view and entails hardly negligible dimensions and high overall costs.

The fact is furthermore stressed that said device does not memorize a selected securing degree for one of the functions.

SUMMARY OF THE INVENTION

The aim of the present invention is therefore to eliminate the disadvantages described above in known types by providing a device which can be applied to a boot and allows the skier to rapidly and easily achieve at least two different functions, such as for example the adjustment and/or the securing of the quarters and of the foot, said device being structurally simple and compact.

Within the scope of the above described aim, an important object is to provide a device which is simple to apply and harmonizes excellently with the boot, and in which the skier can indifferently achieve the two functions.

Not least object is to provide a device which associates the preceding characteristics with the important characteristic of having modest costs and optimum industrialization, which can be obtained with conventional means and with known machinery.

This aim, these objects and others which will become apparent hereinafter are achieved by a ski boot, comprising a shell having a front quarter and a rear quarter and footpressers therein, characterized in that it comprises a lever body pivoted to one of said quarters and has independently activatable adjustment and securing devices for said front and rear quarters and said pressers arranged inside said shell.

One of said devices advantageously comprises a first traction element which passes at the pivoting axis of the lever body, and the rotation of said lever body does not affect the degree of tension of said first element.

BRIEF DESCRIPTION OF THE DRAWINGS

Further characteristics and advantages of the invention will become apparent from the detailed description of two particular but not exclusive embodiments, illustrated only by way of non-limitative example in the accompanying drawings, wherein.

DESCRIPTION OF THE PREFERRED EMBODIMENTS

Figure 1:
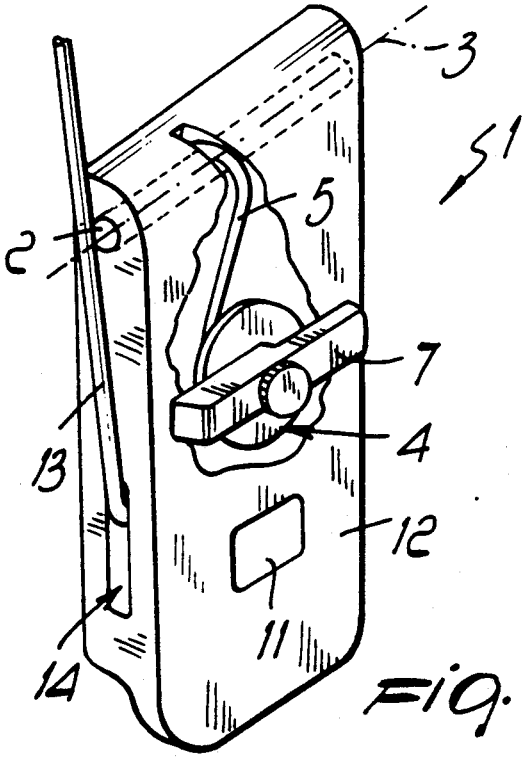
FIG. 1 is an isometric view of a first embodiment of the device.
Figure 2:
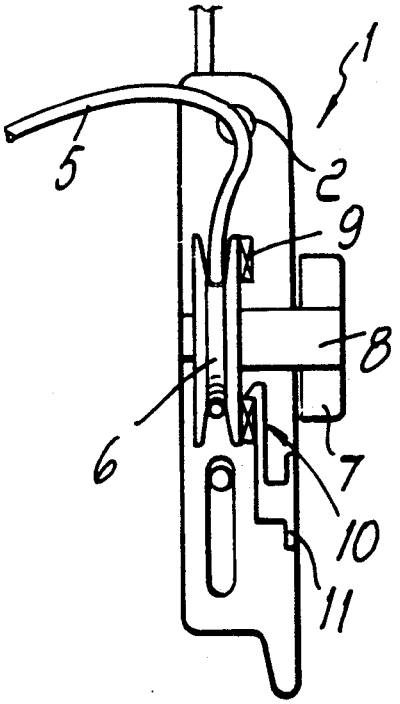
FIG. 2 is a partially sectional side view of the device of FIG. 1.

With reference to the above described figures, the reference numeral 1 indicates a lever body which has an essentially rectangular shape.

Said lever body is rotatably associated, at one of its ends, with a ski boot by means of at least one pivoting pin 2, the axis 3 whereof is arranged perpendicular to said lever body 1.

First devices, indicated by the reference numeral 4, for example for adjusting and/or securing one or more pressers arranged inside the shell of a ski boot, are associated with said lever body 1.

Said first devices comprise a first traction element 5 constituted by a first cable guided on the lever body at the pivoting pin 2 along a direction which is approximately perpendicular to the axis 3.

Said first traction element 5 furthermore interacts with an element for temporarily winding it, preferably constituted by a pulley 6 which is rotatably associated at an adapted seat provided on said lever body 1 and can be actuated for example by means of an adapted knob 7 connected thereto by means of an adapted shaft 8.

Means are furthermore provided for temporarily deactivating a one-way motion which can be imparted to the pulley 6 by means of said knob.

Said means are constituted by a toothed crown 9 which is associated with the pulley 6 and interacts in a ratchet-like manner with a tooth 10 which can be disengaged from the toothed crown 9 by means of an adapted pushbutton 11 which can be activated by the skier and is pivoted to the lever body 1.

The other end of the first traction element 5 is guided on the boot at said one or more pressers arranged inside the shell, so that the activation of the knob 7 provides an adjustment and/or securing at said pressers.

Second devices 12 are furthermore provided, for example to adjust and/or secure the front and rear quarters of a ski boot, and comprise a second traction element 13 which is associated at its ends, for example, with the front quarter, is guided at the rear quarter and passes through an adapted seat 14 provided transversely to the lever body 1 on the opposite side with respect to the pivoting pin 2.

Possible systems for adjusting the tension of the second traction element may be applied directly at the lever body 1 or on the front and/or rear quarters of the boot.

By virtue of the arrangement of the first and second traction elements, the two functions can be activated independently of one another.

The arrangement of the first traction element 5, which passes at the axis 3 of the pivoting pin 2 of the lever body 1, allows in fact not to vary for example the degree of tension imparted to the first traction element 5 by means of the knob 7 when the second devices 12 are activated and the lever body 1 therefore rotates.

Vice versa, it is possible to adjust the tension of the first traction element 5 independently from the preset tension of the second traction element 13.

The two functions are therefore by all means separate though they are controlled by a centralized element.

It has thus been observed that the invention achieves the intended aim and objects, allowing to activate two separate functions in a rapid and easy manner using a single lever body, the activation of said functions being independent from the condition of one another.

The particular arrangement of the first traction element at the lever body furthermore provides a very compact structure which allows excellent integration in both ergonomic and aesthetic terms, by virtue of a very small occupied area, though the total independence of the two functions is preserved.

It is furthermore observed that the overall costs are very low.

The invention is naturally susceptible to numerous modifications and variations, all of which are within the scope of the same inventive concept.

Figure 3:
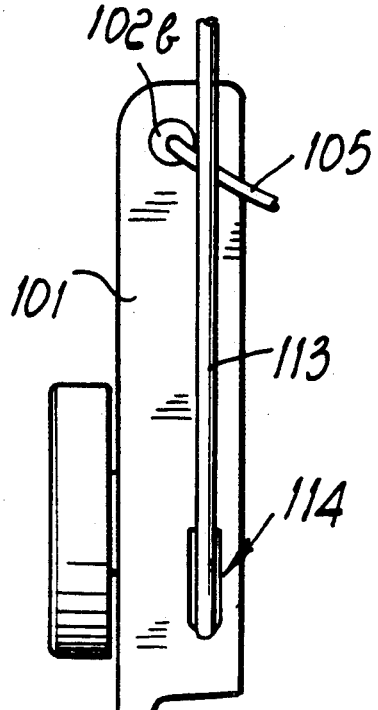
FIG. 3 is a side view of a second embodiment.
Figure 4:
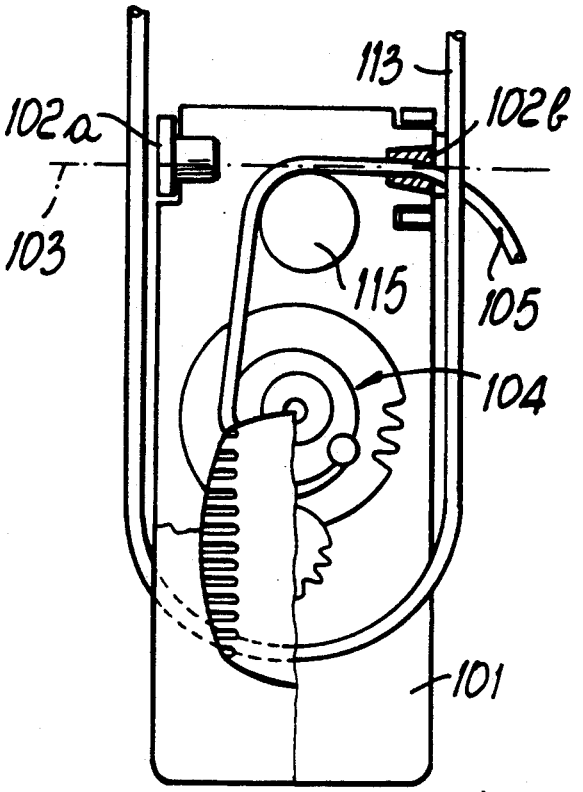
FIG. 4 is a partially sectional plan view of a second embodiment.

Thus for example FIGS. 3 and 4 illustrate a lever body 101, an end whereof is articulated to the boot by means of a pair of pivoting pins 102*a* and 102*b*.

The first traction element 105, which interacts with first devices 104 associated with the lever body 101, is guided at the axis 103 of the pivoting pins 102*a* and 102*b* on a pin or small pulley 115.

The first traction element 105 subsequently passes axially with respect to the pivoting pin 102*b* and then protrudes laterally to the lever body 101 and is then for example guided inside the boot.

The second devices again comprise a second traction element 113 which passes transversely to the lever body 101 at an adapted transverse seat 114.

In this case, too, any rotation imparted to the lever body 101 does not affect the degree of tension imparted to the first traction element 105, as said first traction element is arranged at the axis 103 of the pivoting pins 102*a* and 102*b*.

The two functions can therefore again be activated independently from one another, and the degree of tension imparted to the respective traction element, when the other function is deactivated or not, remains stored for each function.

Figure 5:
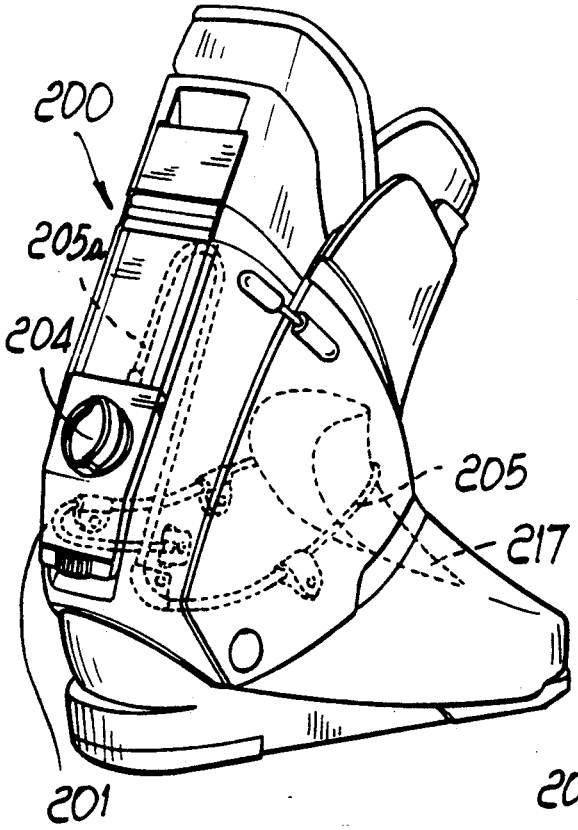
FIG. 5 is an isometric rear view of a ski boot comprising a device according to a further aspect of the invention.
Figure 6:
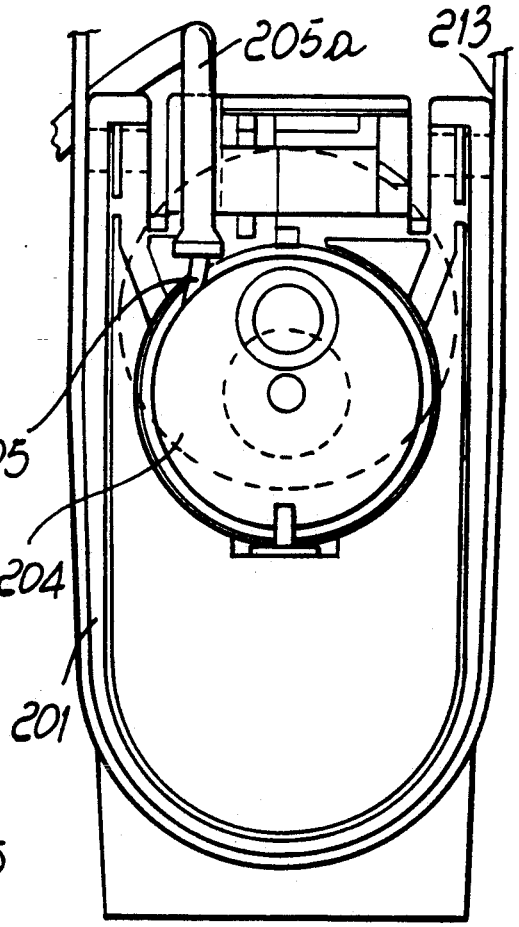
FIG. 6 is a partially sectioned front view of the device of FIG. 5.
Figure 7:
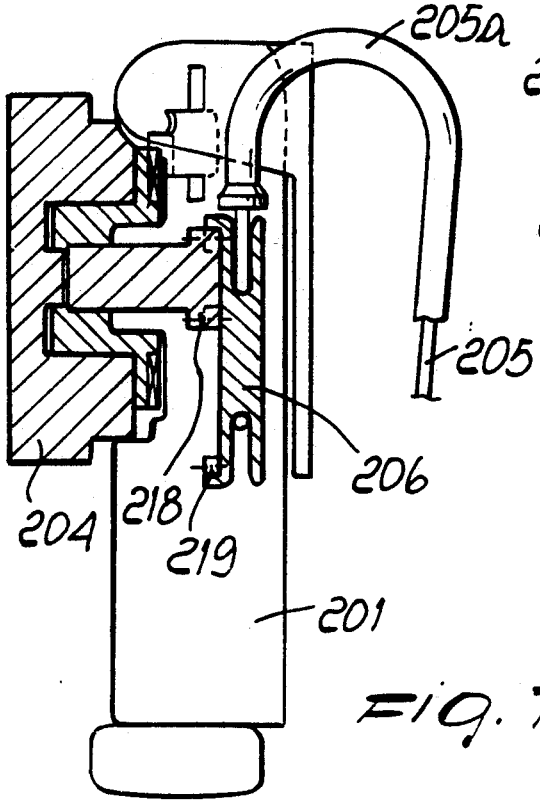
FIG. 7 is a side sectioned view of the device of FIGS. 5 and 6.

FIGS. 5–7 illustrate a ski boot 200 comprising a device 201 according to a further aspect of the invention.

The ski boot 200 comprises a sheath 205*a* partially containing a first traction element 205 which is wound on pulley 206 in a manner similar to what has been described above.

The device, which is constituted by a lever body 201 as described above, also actuates a second traction element 213 adapted, for example, to lock the front quarter.

The first traction element 205 acts upon a foot presser 217, in a per se known manner, and is guided by the sheath 205*a*.

The provision of a sheath 205*a* ensures that the two traction elements are absolutely independent in their adjustment.

The pulley 206 is actuated by a knob 204 through gears 218 and 219.

The dimensions and the materials constituting the individual components of the invention may furthermore naturally be the most appropriate according to the specific requirements.

We claim:

1. Ski boot, comprising a shell having a front quarter and a rear quarter and at least one footpresser arranged therein, said ski boot further comprising a lever body, and pivot means on said quarters for said lever body, thereby said lever body being rotatably pivoted about a pivot axis at a first end thereof to one of said quarters, said lever body being provided with a pulley which is rotatably connected on said lever body, the ski boot further comprising a first traction element which is interconnected between said at least one footpresser and said pulley for providing an adjustable pressing action on said footpresser, and means for manually rotating said pulley which are provided at an outwardly facing surface of said lever body, said first traction element passing through said pivot axis of said lever body and thereby said pressing action provided by said first traction element and said footpresser is independent and invariable of any position of said lever body, the ski boot further comprising a second traction element interconnected between said quarters and a second end of said lever body which is opposite to said pivot axis thereby for providing a securing action of said quarters, said second traction element being connected to said second end of said lever body independently of said pulley and thereby said securing action of said quarters is independent and invariable of any acutation of said pulley.

2. Boot according to claim 1, wherein said lever body has a substantially rectangular boxlike configuration and wherein said pivot means comprises at least one pivoting pin, said first end being rotatably pivoted to one of said quarters by means of said at least one pivoting pin, said pivot axis being defined by said at least one pivoting pin, said first traction element being guided on said lever body and passing through said pivot axis such that a rotation of said lever body does not effect a degree of adjustment of said first traction element.

3. Boot according to claim 1, wherein said pulley is rotatably connected with said lever body at a seat provided therein, a first end of said first traction element being windable upon said pulley for tensioning said first traction element thereof, said means for manually rotating said pulley comprising a knob arranged at an outer face of said lever body and connected to said pulley by means of a shaft, said pulley being provided with a toothed crown engaging in a ratchetlike manner with locking tooth means for providing a one-way locking motion to said pulley, said locking tooth means being disengageable from said toothed crown by means of a pushbutton activatable by a skier at an outer face of said lever body for at least temporarily deactivating the one-way locking motion of said pulley, a second end of said first traction element being guided at said at least one footpresser, whereby an activation of said knob provides a securing adjustment of said at least one footpresser.

4. Boot according to claim 1, wherein said lever body has a substantially rectangular boxlike configuration and wherein said pivot means comprises at least one pivoting pin, said first end of said lever body being rotatably pivoted to one of said quarters by means of said at least one pivoting pin, a transverse through seat being provided in said lever body proximate said second end thereof, said second traction element passing through said transverse through seat, said second traction element interacting with tension adjustment means for tensioning said second traction element thereof, said tension adjustment means being associated with said lever body, whereby a rotation of said lever body mutually tightens and secures said front quarter and said rear quarter.

5. Boot according to claim 1, wherein said lever body has a substantially rectangular boxlike configuration and wherein said pivot means comprises at least one pivoting pin, said first end of said lever body being rotatably pivoted to one of said quarters by means of said at least one pivoting pin, a transverse through seat being provided in said lever body proximate said second end thereof, said second traction element passing through said transverse through seat, said second traction element interacting with tension adjustment means for tensioning said second traction element thereof, said tension adjustment means being associated with one of said quarters, whereby a rotation of said lever body mutually tightens and secures said front quarter and said rear quarter.

6. Boot according to claim 2, wherein said lever body is provided with a small pulley-like pin, said small pulley-like pin being arranged on said lever body such that said first traction element is guided on a periphery thereof, said first traction element passing coaxially to said pivot axis.

7. Boot according to claim 2, wherein said first traction element passes perpendicularly to said pivot axis.

* * * * *